US012478190B1

(12) United States Patent
Shih et al.

(10) Patent No.: US 12,478,190 B1
(45) Date of Patent: Nov. 25, 2025

(54) ANTI-PINCH ELECTRIC BED

(71) Applicant: Chuan-Hang Shih, Lukang Township, Changhua County (TW)

(72) Inventors: Chuan-Hang Shih, Lukang Township (TW); Yu-Chi Yang, Lukang Township (TW)

(73) Assignee: Chuan-Hang Shih, Lukang Township, Changhua County (TW)

( * ) Notice: Subject to any disclaimer, the term of this patent is extended or adjusted under 35 U.S.C. 154(b) by 13 days.

(21) Appl. No.: 18/759,273

(22) Filed: Jun. 28, 2024

(30) Foreign Application Priority Data

May 23, 2024 (TW) ..... 113119003

(51) Int. Cl.
*A47C 20/04* (2006.01)
*A47C 19/02* (2006.01)

(52) U.S. Cl.
CPC ..... *A47C 20/041* (2013.01); *A47C 19/021* (2013.01)

(58) Field of Classification Search
CPC ..... A47C 20/00; A47C 20/04; A47C 20/041; A47C 19/00; A47C 19/02; A47C 19/021
See application file for complete search history.

(56) References Cited

U.S. PATENT DOCUMENTS

2012/0096645 A1* 4/2012 Shih ..... A47C 20/041 5/616
2012/0240337 A1* 9/2012 Shih ..... A61G 7/015 5/616
2014/0250600 A1* 9/2014 McCarty ..... A47C 20/041 5/617
2017/0087039 A1* 3/2017 Shih ..... A61G 7/018
2023/0309702 A1* 10/2023 Freelend ..... A47C 20/041 5/618

* cited by examiner

*Primary Examiner* — Fredrick C Conley
(74) *Attorney, Agent, or Firm* — Birch, Stewart, Kolasch & Birch, LLP

(57) ABSTRACT

An anti-pinch electric bed includes pivotally connected first and second frames, an actuator having a first coupling portion connected with a first pivot portion of the first frame and a second coupling portion pivotally connected with a second pivot portion of the second frame. A first pivot hole of the first pivot portion or a first coupling hole of the first coupling portion is an elongated hole having a contact end. A pin inserts into the first pivot hole and the first coupling hole, and abuts against the contact end. A detect switch is disposed to the first pivot portion or the first coupling portion for sending a signal to stop the actuator or to reverse a rotation of the actuator while detecting that the pin is disengaged from the contact end. As such, the anti-pinch electric bed can prevent injury to people, other living beings, or objects.

8 Claims, 9 Drawing Sheets

ANTI-PINCH ELECTRIC BED

BACKGROUND OF THE INVENTION

1. Field of the Invention

The present invention relates generally to an electric bed and more particularly, to an anti-pinch electric bed.

2. Description of the Related Art

Conventional electric beds can be controlled by the user to lift the back supporting frame or leg supporting frame, and the back supporting frame or leg supporting frame can also be controlled to swing downward to return to a horizontal position. When the back supporting frame or leg supporting frame swings downward, as it gradually approaches the base frame, if children, pets, human hands, or feet accidently enter the space between the back supporting frame (leg supporting frame) and the base frame, they may be pinched by the electric bed. If other objects, such as furniture, are mistakenly placed in the aforesaid space, the objects may be pinched or the electric bed may be damaged. Therefore, how to prevent the electric bed from pinching people, other living beings, or objects has become an urgent issue to be solved in the industry.

SUMMARY OF THE INVENTION

The present invention has been accomplished in view of the above-noted circumstances. It is an objective of the present invention to provide an anti-pinch electric bed, which can prevent injury to people, other living beings, or objects.

To attain the above and other objectives, the present invention provides an anti-pinch electric bed comprising a first frame, a second frame, an actuator, a pin, and a detect switch. The first frame includes a first pivot portion provided with a first pivot hole. The second frame is pivotally connected with the first frame and includes a second pivot portion. The actuator includes an end having a first coupling portion connected with the first pivot portion, and the other end having a second coupling portion pivotally connected with the second pivot portion. The first coupling portion has a first coupling hole corresponding to the first pivot hole. One of the first pivot hole and the first coupling hole is an elongated hole having a contact end. The actuator drives the second frame to swing relative to the first frame. The pin is inserted into the first pivot hole and the first coupling hole and abutted against the contact end of the elongated hole to connect the first coupling portion and the first pivot portion in a way that the pin is reciprocatingly moveable along the elongated hole. The detect switch is disposed to the first pivot portion or the first coupling portion to detect whether the pin is in contact with the contact end of the elongated hole. When the detect switch detects that the pin is not in contact with the contact end of the elongated hole, the detect switch sends a signal to stop the actuator or to reverse a rotation of the actuator. As a result, the anti-pinch electric bed can prevent injury to people, other living beings, or objects.

BRIEF DESCRIPTION OF THE DRAWINGS

The present invention will become more fully understood from the detailed description given herein below and the accompanying drawings which are given by way of illustration only, and thus are not limitative of the present invention, and wherein.

DETAILED DESCRIPTION OF THE INVENTION

Figure 1:
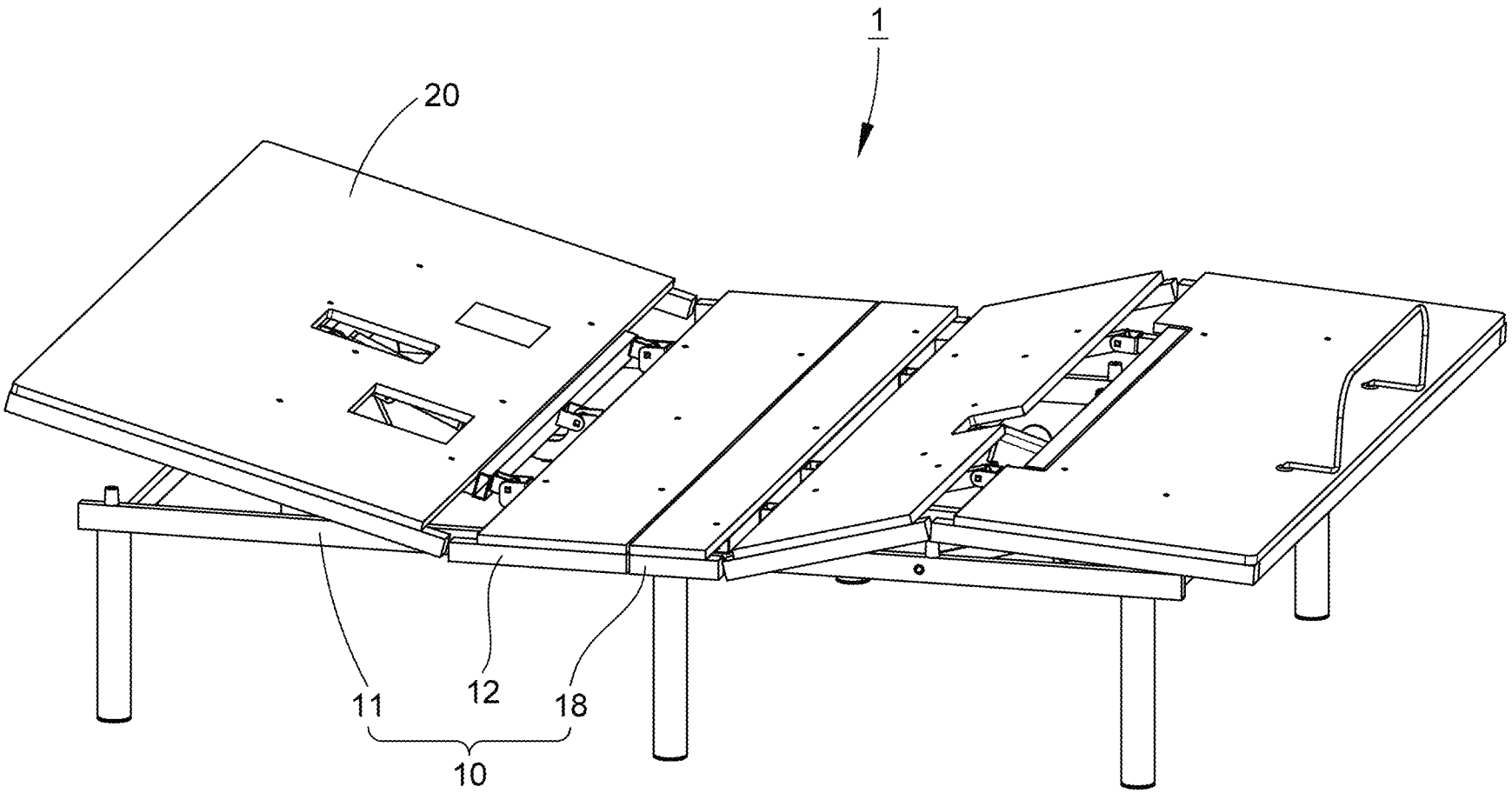
FIGS. 1 to 3 are various perspective views of an anti-pinch electric bed according to a first preferred embodiment of the present invention.
Figure 2:
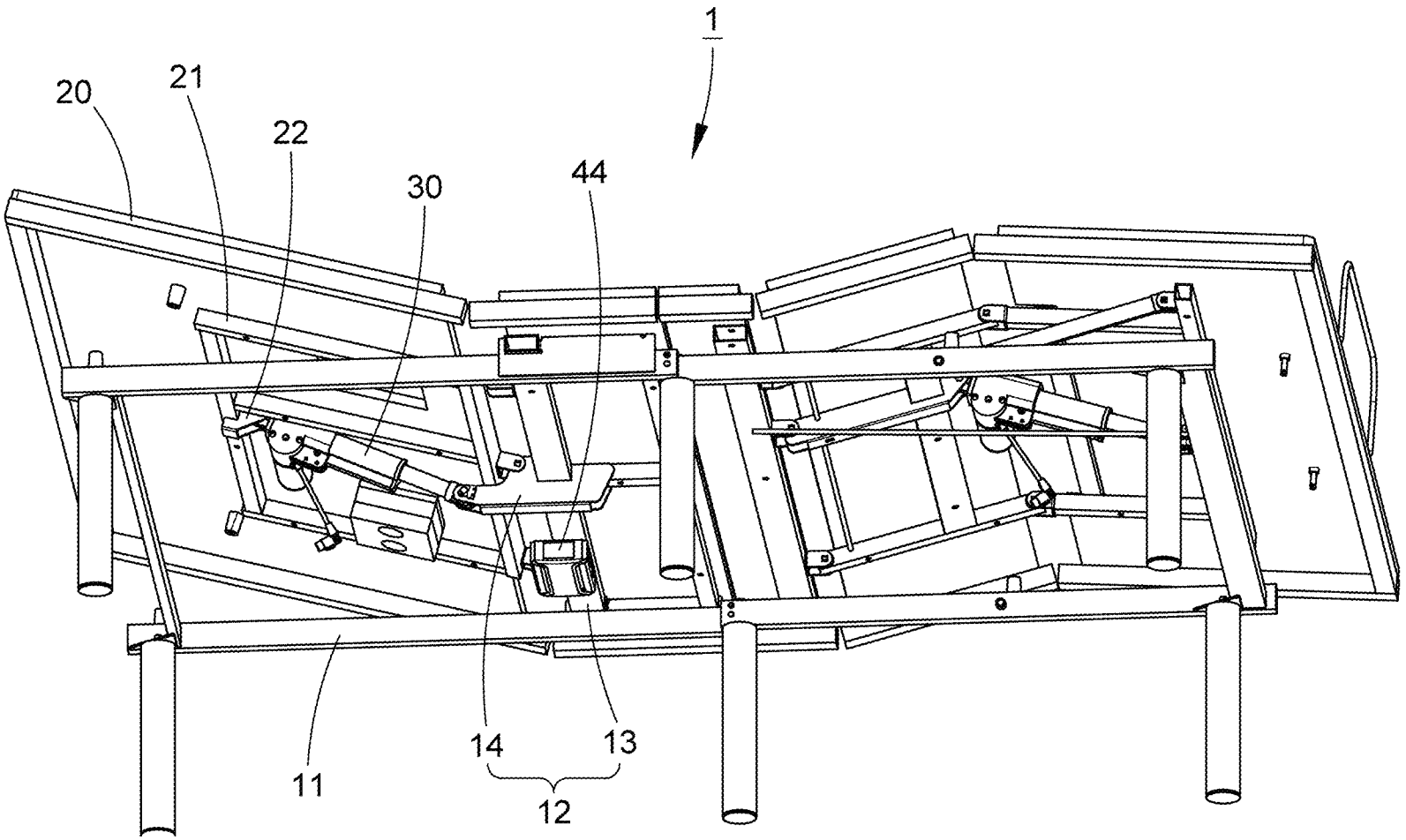
Figure 3:
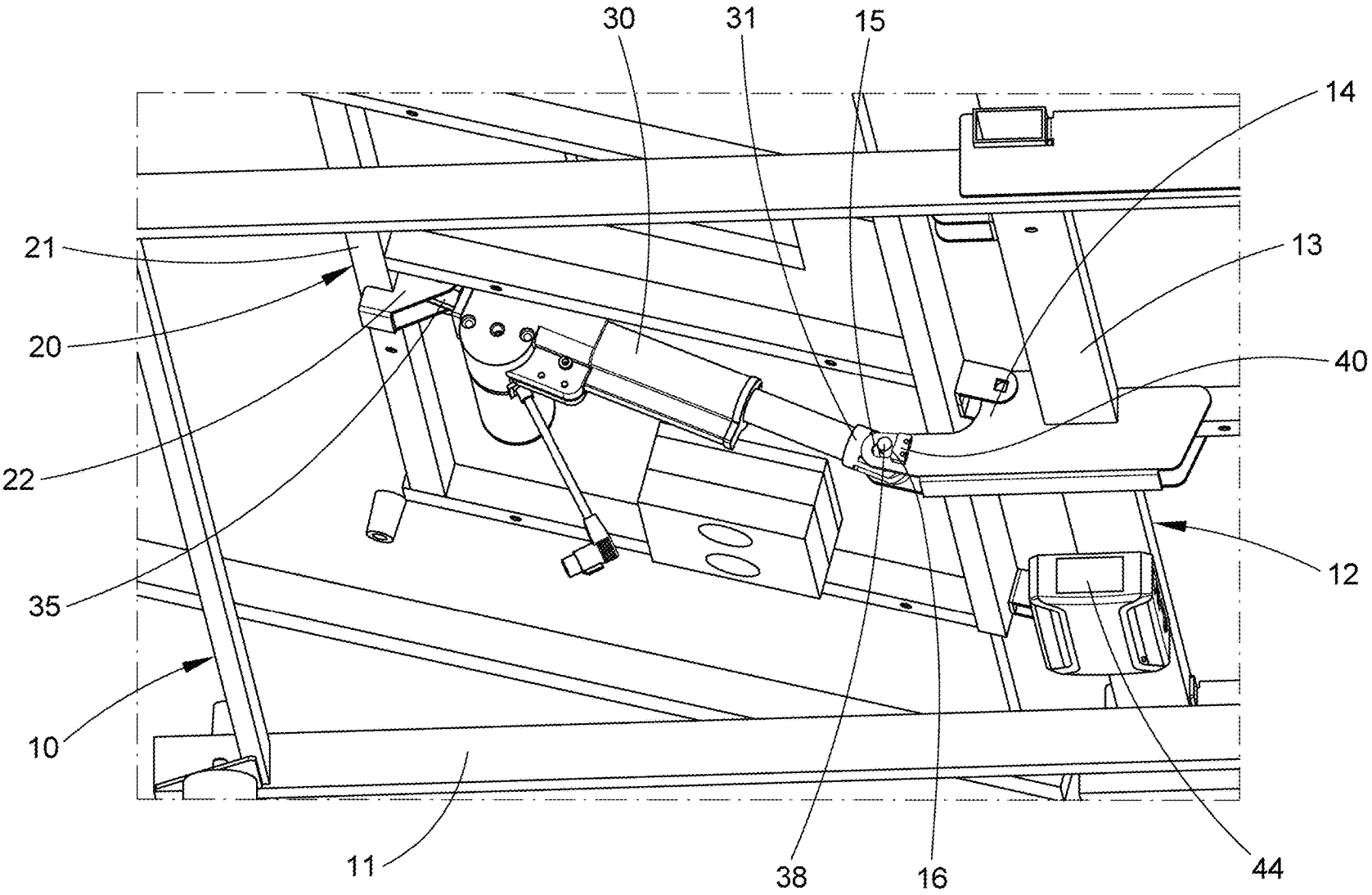
Figure 4:
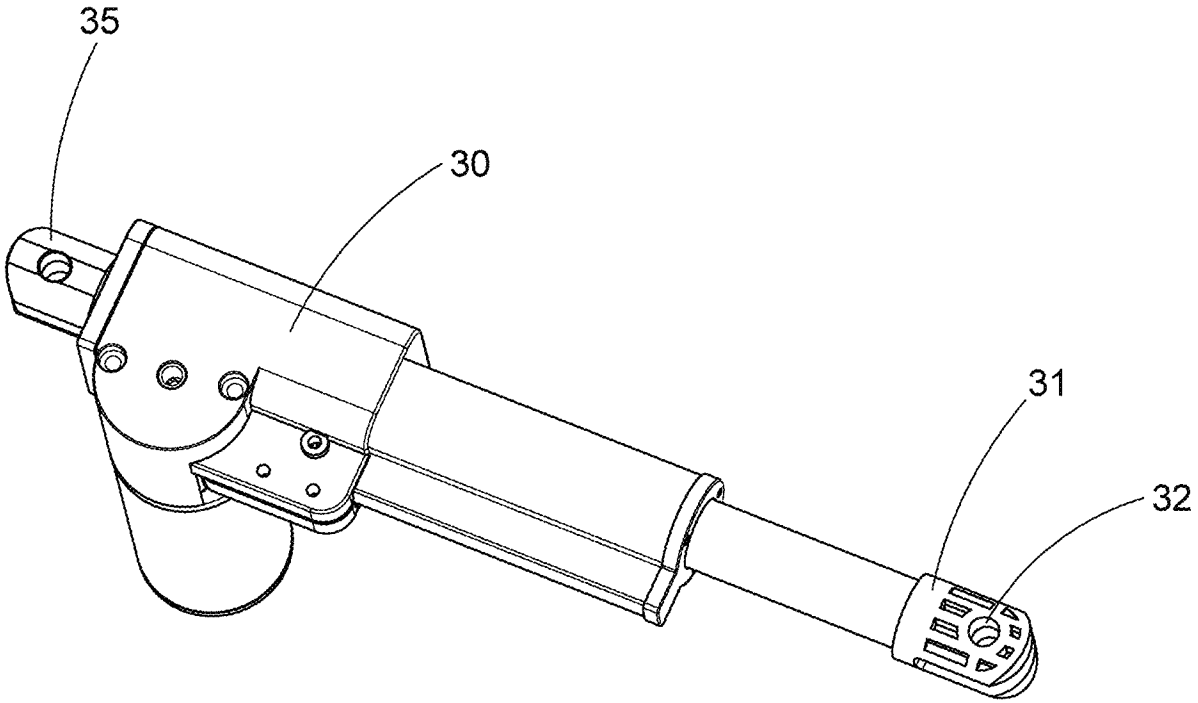
FIG. 4 is a perspective view of an actuator of the anti-pinch electric bed according to the first preferred embodiment of the present invention.

The structure and technical features of the present invention will be detailedly described hereunder by three embodiments and accompany drawings. As shown in FIGS. 1-4, an anti-pinch electric bed 1 provided by a first preferred embodiment of the present invention includes a first frame 10, a second frame 20, an actuator 30, a pin 38, and a detect switch 40. For illustrative purposes, the left side of FIG. 1 is referred to as the front side, and the right side is referred to as the rear side. However, this should not be construed as limiting the scope of the claims of the present application.

The first frame 10 is stationary, i.e., being fixed and immobile. It comprises a base frame 11, a front buttock supporting frame 12 disposed on the base frame 11, and a rear buttock supporting frame 18 also disposed on the base frame 11 and located behind the front buttock supporting frame 12. The front buttock supporting frame 12 includes a first framework 13, a first pivot portion 14 extending downward and forward from the first framework 13, and two first pivot holes 15 provided at the first pivot portion 14. These first pivot holes 15 are elongated holes, where the term "elongated hole" refers to a hole having a length greater than its width. Further the rear side of the elongated hole has a contact end 16.

The second frame 20 has a second framework 21 pivotally connected with the first frame 10, and a second pivot portion 22 located at a front side of the second framework 21. The second frame 20 can swing up and down relative to the first frame 10. In this embodiment, the second frame 20 serves as a back supporting frame, but in other embodiments, it can be a thigh supporting frame or a calf supporting frame.

The actuator 30 has two ends, namely an end and the other end or a front end and a rear end, provided respectively with a first coupling portion 31 connected with the first pivot portion 14, and a second coupling portion 35 pivotally connected with the second pivot portion 22. The first coupling portion 31 has two first coupling holes 32 corresponding to the two first pivot holes 15. The actuator 30 can drive the second frame to swing up and down relative to the first frame 10.

The pin 38 is inserted into the two first pivot holes 15 and the two first coupling holes 32 and abutted against the contact ends 16 of the elongated holes (i.e., the first pivot holes 15), thereby connecting the first coupling portion 31 and the first pivot portion 14 together. The cross-section of the pin 38 has a circular shape with a diameter slightly smaller than the width of the elongated holes, allowing the pin 38 to reciprocatingly move along the elongated holes (i.e., the first pivot holes 15).

The detect switch 40 is a limit switch and mounted to a place of the first pivot portion 14, which is adjacent to the contact end 16 of one of the first pivot holes 15, for detecting whether the pin 38 is in contact with the contact end 16 of the elongated hole (i.e., the first pivot hole 15). When the pin 38 abuts against the contact end 16, it also presses against the detect switch 40. When the pin 38 disengages from the contact end 16, it also disengages from the detect switch 40. In this way, as soon as the pin 38 is disengaged from the detect switch 40, the disengagement can be sensed by the detect switch 40 immediately. When the detect switch 40 senses that the pin 38 has disengaged from the contact end 16 of the first pivot hole 15, it sends a signal to a control unit 44. Since the control unit 44 is disposed to the first framework 13 and electrically connected with the detect switch 40 and the actuator 30, it can control the operation of the actuator based on the signal from the detect switch 40, causing the actuator 30 to stop or reverse its direction of rotation.

Figure 5:
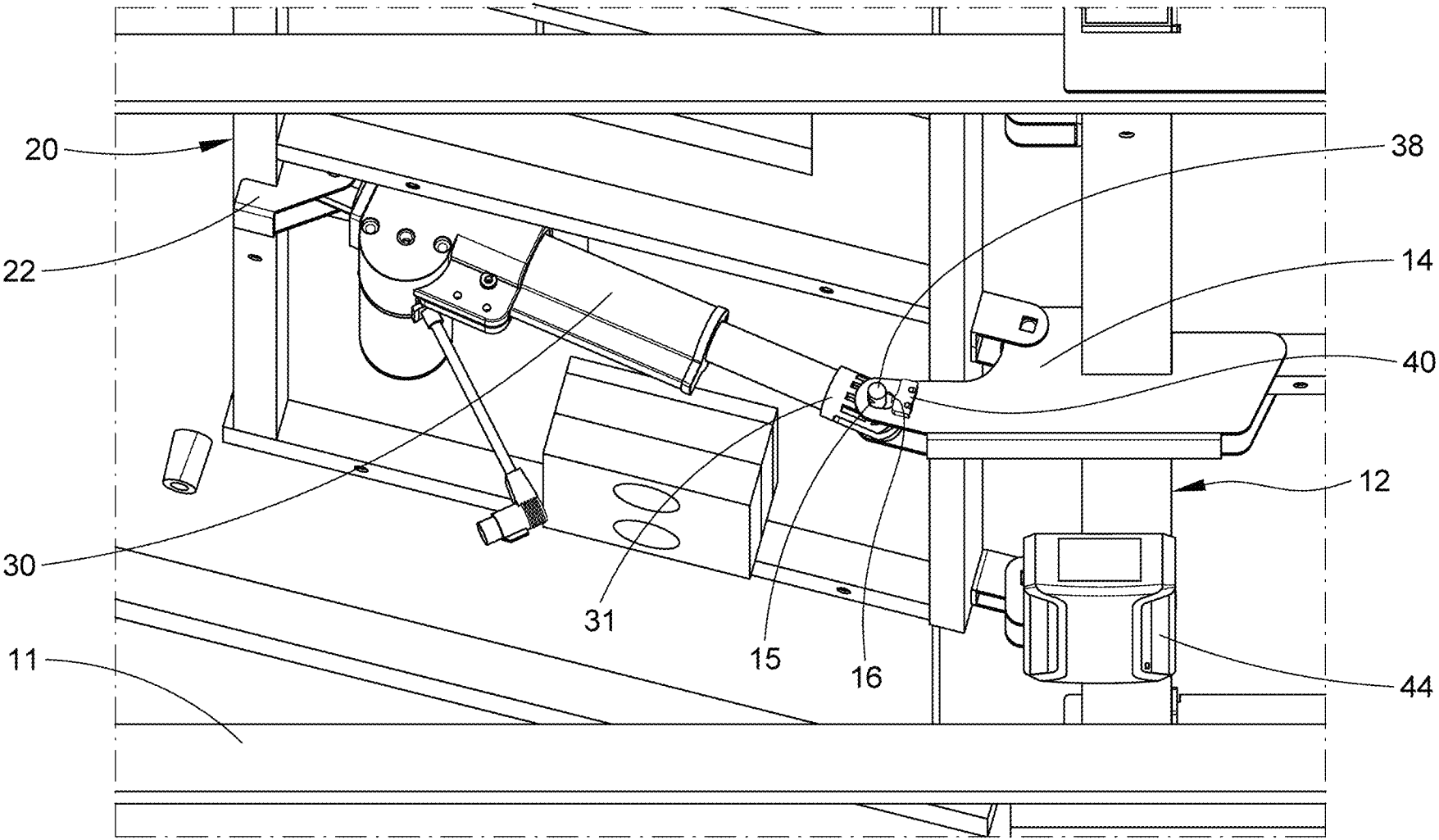
FIG. 5 is a schematic view showing the anti-pinch electric bed of the first preferred embodiment of the present invention is in a state of use.

With the above disclosed structural features, as the actuator 30 gradually extends, the first coupling portion 31 drives the pin 38 to abut against the contact ends 16 of the first pivot holes 15, allowing the second frame 20 to be driven by the actuator 30 to swing upward. Conversely, as the actuator 30 gradually retracts, the second frame 20 swings downward. During this process, the weight of the second frame 20 exerts on the pin 38 through the actuator 30, such that the pin 38 will continuously abut against the contact ends 16 of the first pivot holes 15. If, at this time, children, pets, or human hands or feet are accidently caught between the second frame 20 and the base frame 11, the second frame 20 cannot continue to swing downward. Under the continued retraction of the actuator 30, the pin 38 will move away from the contact ends 16, as shown in FIG. 5. Once the pin 38 is disengaged from the contact ends 16, the disengagement of the pin 38 will be sensed by the detect switch 40, which then sends a signal to the control unit 44 to stop actuator 30 or reverse the rotation direction of the actuator 30 (i.e., extending the actuator 30) to cause that the second frame 20 no longer swing downward or the second frame 20 starts to swing upward instead, thereby preventing injury to people, other living beings, or objects to achieve the objective of the present invention.

Figure 6:
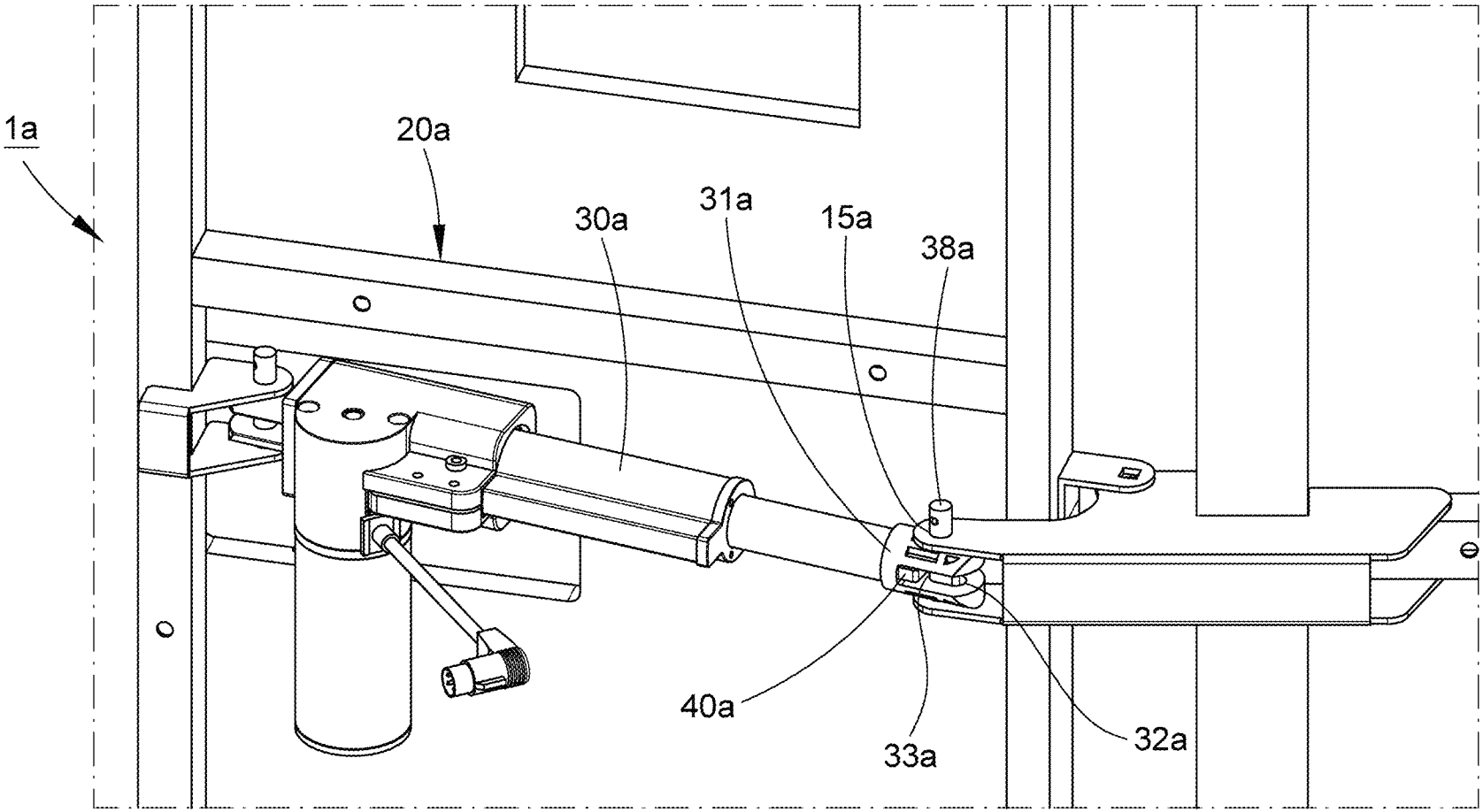
FIG. 6 is a perspective view of a part of an anti-pinch electric bed according to a second preferred embodiment of the present invention.
Figure 7:
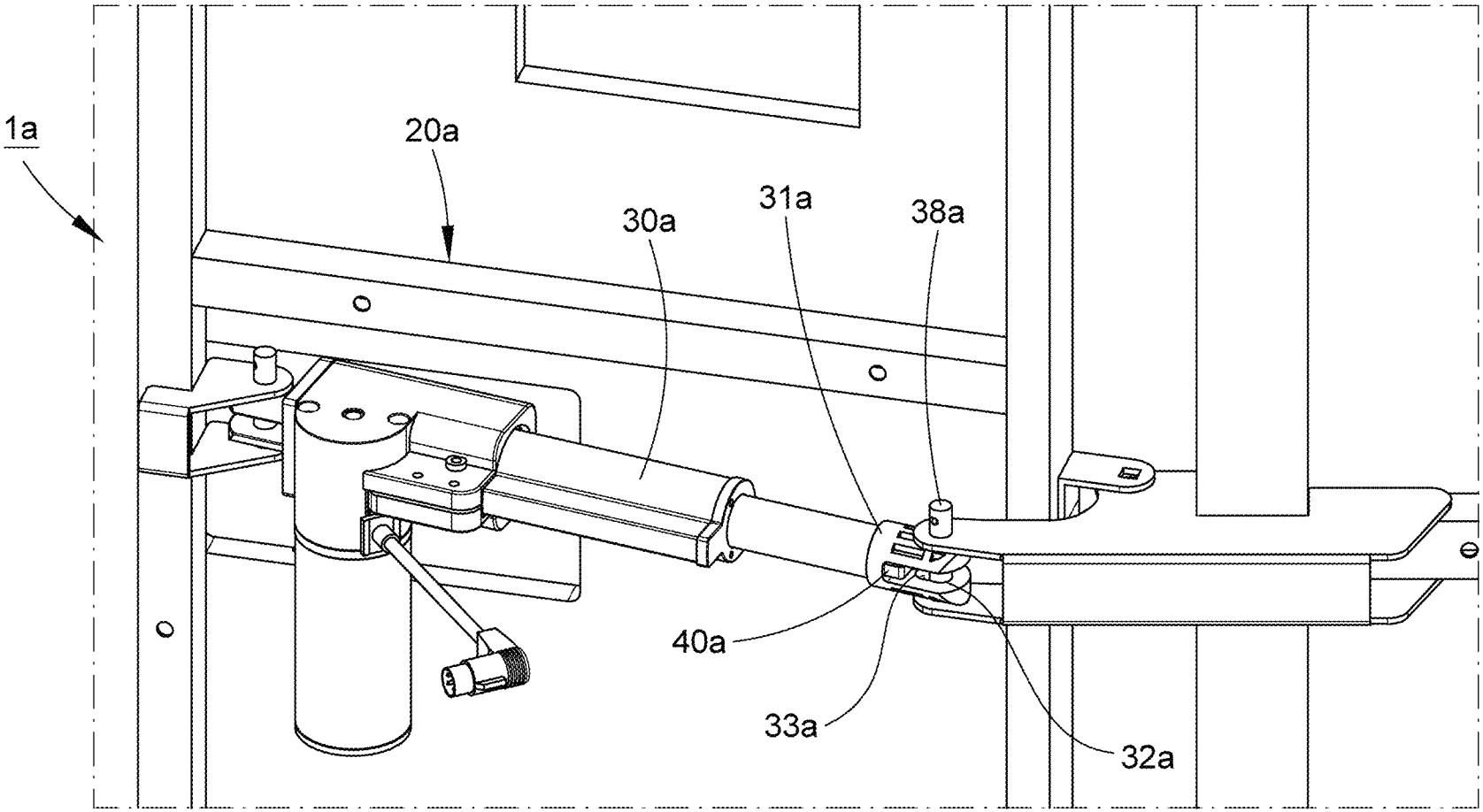
FIG. 7 is a schematic view showing the anti-pinch electric bed of the second preferred embodiment of the present invention is in a state of use.

Based on the design of the above-mentioned structural features, various modifications to the structure of the anti-pinch electric bed 1 may be made. For example, FIG. 6 shows an anti-pinch electric bed 1*a* provided by a second preferred embodiment of the present invention, which has a structure similar to that of the first embodiment. The difference lies in: the first pivot hole 15*a* is a circular hole while the first coupling hole 32*a* is an elongated hole, and the contact end 33*a* of the first coupling hole 32*a* is located at the front end of the first coupling hole 32*a*. The detect switch 40*a* is located at the first coupling portion 31*a* and is adjacent to the contact end 33*a*. In this way, when the actuator 30*a* gradually extends, the contact end 33*a* of the first coupling hole 32*a* abuts against the pin 38*a*, allowing the second frame 20*a* to be driven by the actuator 30*a* to swing upward. Conversely, as the actuator 30*a* gradually retracts, the second frame 20*a* swings downward. During this process, the weight of the second frame 20*a* exerts on the contact end 33*a* through the actuator 30*a*, such that the contact end 33*a* continuously abuts against the pin 38*a*. If, at this time, a child, pet, or a human hand or foot is accidently caught between the second frame 20*a* and the base frame of the first frame, the second frame 20*a* cannot continue to swing downward. Under the continued retraction of the actuator 30*a*, the contact end 33*a* will be disengaged from the pin 38*a*, as shown in FIG. 7. Once the pin 38*a* is disengaged from the contact end 33*a*, the disengagement of the pin 38*a* will be sensed by the detect switch 40*a*, such that the actuator 30*a* can be controlled to stop or reverse its rotational direction (i.e., extending the actuator 30*a*), thereby preventing injury to people, other living beings, or objects so as to achieve the objective of the present invention.

Figure 8:
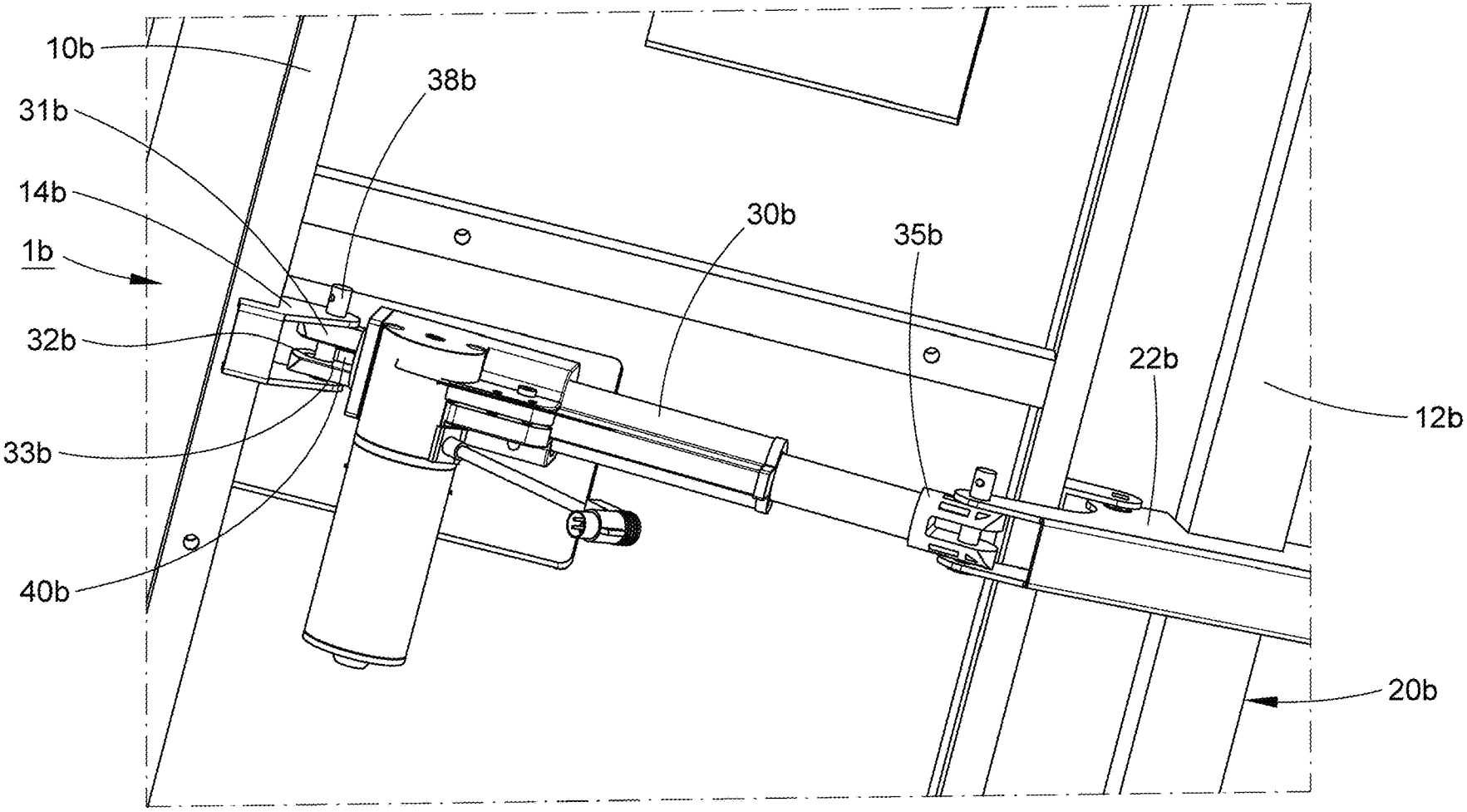
FIG. 8 is a perspective view of a part of an anti-pinch electric bed according to a third preferred embodiment of the present invention.
Figure 9:
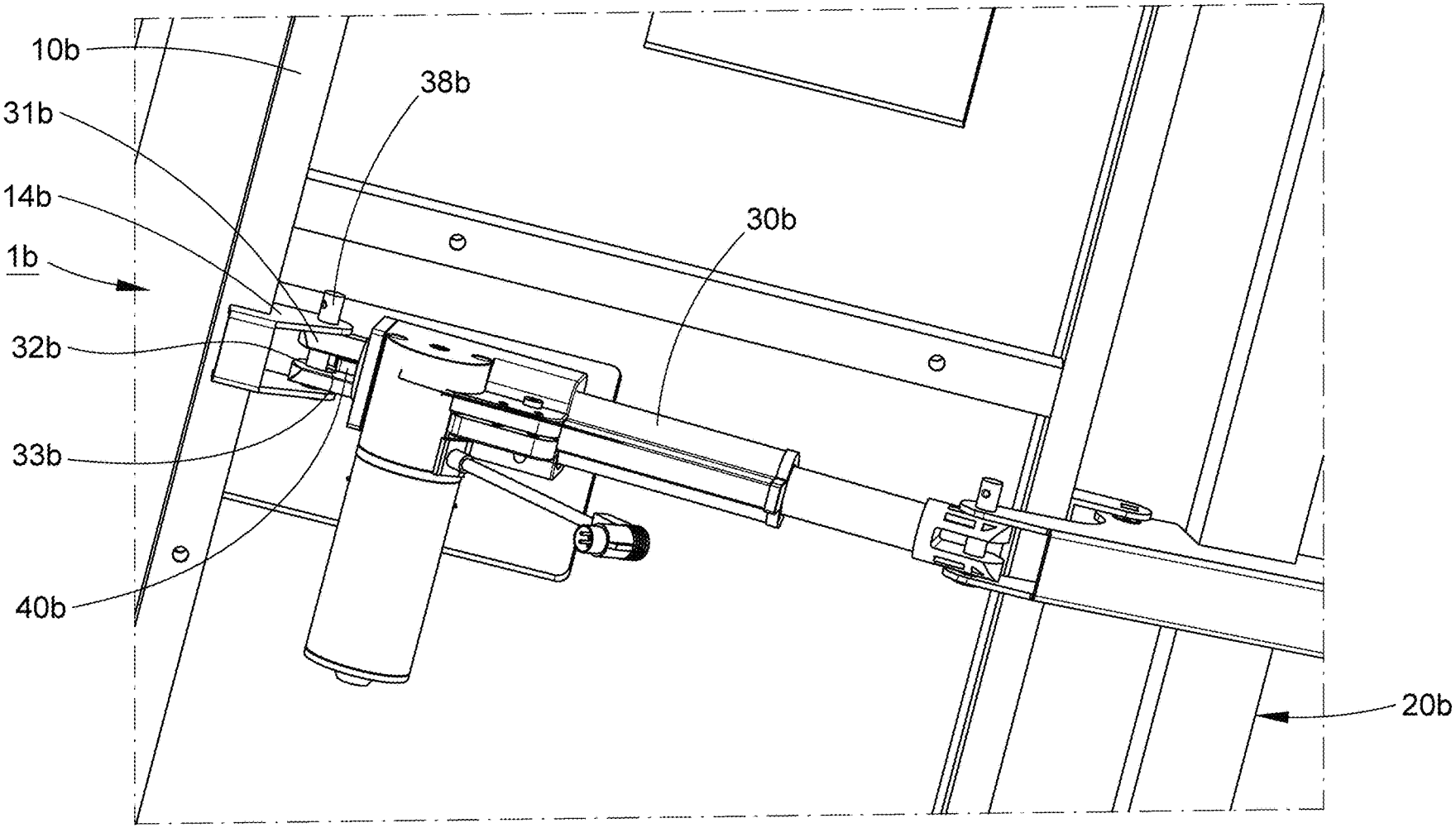
FIG. 9 is a schematic view showing the anti-pinch electric bed of the third preferred embodiment of the present invention is in a state of use.

Furthermore, FIG. 8 shows an anti-pinch electric bed 1*b* provided by a third preferred embodiment of the present invention, which has a structure similar to that of the second embodiment, except that the roles of the first frame and the second frame are swapped. Specifically, the first frame 10*b*, which is the back supporting frame, can be driven by the actuator 30*b* to swing. The second frame 20*b* now includes the stationary base frame, the front buttock supporting frame 12*b*, and the rear buttock supporting frame. The actuator 30*b* has a front end with a first coupling portion 31*b* connected with the first pivot portion 14*b*, and a rear end with a second coupling portion 35*b* pivotally connected with the second pivot portion 22*b*. The first coupling hole 32*b* is the elongated hole, and the detect switch 40*b* is positioned at the first coupling portion 31*b* adjacent to the contact end 33*b*. Thus, when the actuator 30*b* extends gradually, the contact end 33*b* of the first coupling hole 32*b* abuts against the pin 38*b*, causing the first frame 10*b* to be driven by the actuator 30*b* to swing upward. Conversely, when the actuator 30*b* retracts gradually, the first frame 10*b* swings downward. During this process, the weight of the first frame 10*b* exerts on the pin 38*b* through the first pivot portion 14*b*, such that the pin 38*b* continuously abuts against the contact end 33*b*. If, at this point, a child, pet, or human hand or foot is accidently caught between the first frame 10*b* and the base frame of the second frame 20*b*, the first frame 10*b* cannot continue to swing downward. As the actuator 30*b* continues to retract, the contact end 33*b* will be disengaged from the pin 38*b*, as shown in FIG. 9. Once the pin 38*b* is disengaged from the contact end 33*b*, the disengagement of the pin 38*b* will be detected by the detect switch 40*b*, such that the actuator 30*b* can be controlled to stop or reverse the rotational direction (i.e., extending the actuator), thereby preventing injury to people, other living beings, or objects so as to achieve the objective of the present invention.

Similarly, in the third embodiment, the elongated hole and the detect switch 40*b* can also be arranged at the first pivot portion 14*b*. In this case, the first pivot hole is the elongated hole, achieving the same anti-pinch effect.

Moreover, the detect switch 40 may be of other types, such as an infrared sensor switch or a laser sensor switch, as long as it can detect whether the pin is disengaged from the contact end. If the actuator has a built-in control unit, the detect switch can also be directly electrically connected to the actuator, such that the actuator can act upon receiving the signal from the detect switch. Any such readily conceivable structural changes should be encompassed within the scope of the claims of the patent application.

What is claimed is:

1. An anti-pinch electric bed, comprising:

a first frame including a first pivot portion provided with a first pivot hole;

a second frame pivotally connected with the first frame and including a second pivot portion;

an actuator including an end having a first coupling portion connected with the first pivot portion, and the other end having a second coupling portion pivotally connected with the second pivot portion, wherein the first coupling portion has a first coupling hole corresponding to the first pivot hole, one of the first pivot hole and the first coupling hole is an elongated hole having a contact end, and the actuator drives the second frame to swing relative to the first frame;

a pin inserted into the first pivot hole and the first coupling hole and abutted against the contact end of the elongated hole to connect the first coupling portion and the first pivot portion in a way that the pin is reciprocatingly moveable along the elongated hole; and a detect switch disposed to the first pivot portion or the first coupling portion to detect whether the pin is in contact with the contact end of the elongated hole, wherein when the detect switch detects that the pin is not in contact with the contact end of the elongated hole, the detect switch sends a signal to stop the actuator or to reverse a rotation of the actuator.

2. The anti-pinch electric bed as claimed in claim 1, wherein the first frame is stationary and the second frame is drivenable by the actuator to swing; the first pivot hole is the elongated hole; the detect switch is disposed to the first pivot portion.

3. The anti-pinch electric bed as claimed in claim 1, wherein the first frame is stationary and the second frame is drivenable by the actuator to swing; the first coupling hole is the elongated hole; the detect switch is disposed to the first coupling portion.

4. The anti-pinch electric bed as claimed in claim 1, wherein the second frame is stationary and the first frame is drivenable by the actuator to swing; the first pivot hole is the elongated hole; the detect switch is disposed to the first pivot portion.

5. The anti-pinch electric bed as claimed in claim 1, wherein the second frame is stationary and the first frame is drivenable by the actuator to swing; the first coupling hole is the elongated hole; the detect switch is disposed to the first coupling portion.

6. The anti-pinch electric bed as described in claim 1, wherein the detect switch is a limit switch, an infrared sensor switch, or a laser sensor switch.

7. The anti-pinch electric bed as claimed in claim 1, wherein the detect switch is a limit switch; when the pin is abutted against the contact end of the elongated hole, the pin presses against the detect switch; when the pin is not in contact with the contact end of the elongated hole, the pin is disengaged from the detect switch.

8. The anti-pinch electric bed as claimed in claim 1, further comprising a control unit electrically connected with the detect switch and the actuator in a way that the control unit receives the signal from the detect switch to control an operation of the actuator.

* * * * *